US011037485B2

(12) United States Patent
Zhang et al.

(10) Patent No.: US 11,037,485 B2
(45) Date of Patent: Jun. 15, 2021

(54) METHOD FOR COMPENSATING FOR LUMINANCE OF DISPLAY PANEL, DISPLAY PANEL AND DISPLAY DEVICE

(71) Applicants: BOE TECHNOLOGY GROUP CO., LTD., Beijing (CN); ORDOS YUANSHENG OPTOELECTRONICS CO., LTD., Inner Mongolia (CN)

(72) Inventors: Hao Zhang, Beijing (CN); Jianchao Zhu, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 470 days.

(21) Appl. No.: 16/083,315

(22) PCT Filed: Jan. 5, 2018

(86) PCT No.: PCT/CN2018/071584
§ 371 (c)(1),
(2) Date: Sep. 7, 2018

(87) PCT Pub. No.: WO2018/214516
PCT Pub. Date: Nov. 29, 2018

(65) Prior Publication Data

US 2021/0090486 A1 Mar. 25, 2021

(30) Foreign Application Priority Data

May 26, 2017 (CN) ..... 201710384365.2

(51) Int. Cl.
*G09G 3/32* (2016.01)

(52) U.S. Cl.
CPC ..... *G09G 3/32* (2013.01); *G09G 2300/0452* (2013.01); *G09G 2300/08* (2013.01);
(Continued)

(58) Field of Classification Search
CPC ..... G09G 3/32; G09G 3/3208; G09G 3/3233–325; G09G 3/3275–3291;
(Continued)

(56) References Cited

U.S. PATENT DOCUMENTS

2007/0109327 A1* 5/2007 Cok ..... G09G 3/2003 345/690
2009/0195481 A1* 8/2009 Taguchi ..... G09G 3/3607 345/55
(Continued)

FOREIGN PATENT DOCUMENTS

CN 101887189 A 11/2010
CN 104570457 A 4/2015
(Continued)

OTHER PUBLICATIONS

PCT International Search Report, Application No. PCT/CN2018/071584, dated Mar. 30, 2018, 8 pages: with English translation.
(Continued)

*Primary Examiner* — Nathan Danielsen
(74) *Attorney, Agent, or Firm* — Armstrong Teasdale LLP

(57) ABSTRACT

Embodiments of the present disclosure relate to a method for compensating for luminance of a display panel, a display panel, and a display device. The display panel includes a display region and a non-display region, the display region and the non-display region having a boundary therebetween, the boundary passing through a pixel region and a non-pixel region of the display panel, a portion of the non-pixel region located within the display region forming a dark region within the display region, the method includes determining
(Continued)

the luminance of the neighboring pixel adjacent to the dark region among the display pixels of the pixel region based on an area of the dark region, so as to compensate for the luminance of the dark regions with the luminance of the neighboring pixel.

20 Claims, 4 Drawing Sheets

(52) U.S. Cl.
CPC ..... *G09G 2310/0232* (2013.01); *G09G 2320/0233* (2013.01); *G09G 2320/0626* (2013.01); *G09G 2360/147* (2013.01)

(58) Field of Classification Search
CPC ..... G09G 3/36; G09G 3/3644; G09G 3/3685–3696; G09G 2300/02; G09G 2300/043; G09G 2300/0452; G09G 2300/0465; G09G 2300/08; G09G 2310/0232; G09G 2320/02; G09G 2320/0233; G09G 2320/0242; G09G 2320/0626; G09G 2320/0686; G09G 2360/147; G09G 2360/16
See application file for complete search history.

(56) References Cited

U.S. PATENT DOCUMENTS

| | | | | |
|---|---|---|---|---|
| 2009/0309813 | A1 | 12/2009 | Fujita | |
| 2010/0259566 | A1* | 10/2010 | Watanabe | G02B 27/1066 345/690 |
| 2016/0179453 | A1* | 6/2016 | Jepsen | G09G 3/002 345/690 |
| 2018/0308413 | A1* | 10/2018 | Jin | G09G 3/20 |
| 2018/0374426 | A1* | 12/2018 | Chen | G09G 5/10 |

FOREIGN PATENT DOCUMENTS

| | | | |
|---|---|---|---|
| CN | 104809980 | A | 7/2015 |
| CN | 205318057 | U | 6/2016 |
| CN | 106530993 | A | 3/2017 |
| CN | 107039020 | A | 8/2017 |
| JP | 2006276580 | A | 10/2006 |

OTHER PUBLICATIONS

PCT Written Opinion, Application No. PCT/CN2018/071584, dated Mar. 30, 2018, 6 pages.: with English translation of relevant part.
China First Office Action, Application No. 201710384365.2, dated May 2, 2018, 10 pps.: with English translation.

* cited by examiner

Determine the luminance of a neighboring pixel adjacent to the dark region among the display pixels of the pixel region based on an area of the dark region, so as to compensate for the luminance of the dark region with the luminance of the neighboring pixel

301

METHOD FOR COMPENSATING FOR LUMINANCE OF DISPLAY PANEL, DISPLAY PANEL AND DISPLAY DEVICE

CROSS REFERENCE TO RELATED APPLICATIONS

This patent application is a National Stage Entry of PCT/CN2018/071584 filed on Jan. 5, 2018, which claims the benefit and priority of Chinese Patent Application No. 201710384365.2 filed on May 26, 2017, the disclosures of which are incorporated herein by reference in their entirety as part of the present application.

BACKGROUND

Embodiments of the present disclosure relate to the field of display technology, and in particular, to a method for compensating for the luminance of a display panel, a display panel, and a display device.

In recent years, smart wearable devices such as smart watches or head-mounted display devices have been widely used. For aesthetic and ergonomical considerations, the display panel of the smart wearable device usually adopts a non-rectangular design such as a circular shape or an elliptical shape.

BRIEF DESCRIPTION

The embodiments of the present disclosure provide a method for compensating for the luminance of a display panel, a display panel, and a display device.

An aspect of the present disclosure provides a method for compensating for luminance of a display panel, wherein the display panel may include a display region and a non-display region, the display region and the non-display region having a boundary therebetween, the boundary passing through a pixel region and a non-pixel region of the display panel, a portion of the non-pixel region located within the display region forming a dark region within the display region. The method may include determining the luminance of a neighboring pixel adjacent to the dark region among display pixels of the pixel region based on an area of the dark region, so as to compensate for the luminance of the dark region with the luminance of the neighboring pixel.

In an embodiment of the present disclosure, the determined luminance of the neighboring pixels may include a base part and a compensation part for compensating for the luminance of the dark region, the base part is proportional to a ratio of an area of a portion of the corresponding neighboring pixel located within the display region to an area of a single pixel, and for each dark region, a sum of the compensation parts of all neighboring pixels is proportional to the ratio of the area of the dark region to the area of a single pixel.

In an embodiment of the present disclosure, the neighboring pixels may include at least two edge pixels each sharing a common edge with the dark region.

In an embodiment of the present disclosure, the luminance of the edge pixel may be determined by the following equation:

$$L(P_i) = \frac{S_{Pi}}{S} * L + \frac{a}{S} * \frac{d_i}{\sum_{j=1}^{n} d_j} * L;$$

where, i=1, . . . , n, n is a positive integer greater than or equal to two, $L(P_i)$ is the luminance of a $i^{-th}$ edge pixel, S is the area of the single pixel, Sp, is an area of a portion of the $i^{-th}$ edge pixel located within the display region, a is the area of the dark region, $d_i$ is a distance from a center of the $i^{-th}$ edge pixel to a center of the dark region, and L is display luminance of the single pixel other than the neighboring pixels in the display region, under a predetermined color.

In an embodiment of the present disclosure, the luminance of the edge pixel may be determined by the following equation:

$$L(P_i) = \frac{S_{Pi}}{S} * L + \frac{a}{S} * \frac{b_i}{\sum_{j=1}^{n} b_j} * L;$$

where, i=1, . . . , n, n is a positive integer greater than or equal to two, $L(P_i)$ is the luminance of a $i^{-th}$ edge pixel, S is the area of the single pixel, Sp, is an area of a portion of the $i^{-th}$ edge pixel located within the display region, a is the area of the dark region, $b_i$ is a length of a common portion of a edge of the $i^{-th}$ edge pixel and a edge of the dark region, and L is display luminance of the single pixel other than the neighboring pixels in the display region, under a predetermined color.

In an embodiment of the present disclosure, the neighboring pixels may include at least two edge pixels each sharing a common edge with the dark region and a diagonal pixel disposed diagonally to the dark region.

In an embodiment of the present disclosure, the luminance of the edge pixel may be determined by the following equation:

$$L(P_i) = \frac{S_{Pi}}{S} * L + \frac{a}{S} * \frac{d_i}{\sum_{j=1}^{n} d_j + d} * L;$$

the luminance of the diagonal pixel may be determined by the following equation:

$$L(P_3) = L + \frac{a}{S} * L - \frac{a}{S} * \sum_{k=1}^{n} \frac{d_k}{\sum_{j=1}^{n} d_j + d} * L;$$

where, n is a positive integer greater than or equal to two, i=1, . . . , n, $L(P_i)$ is the luminance of a $i^{-th}$ edge pixel, $L(P_3)$ is the luminance of the diagonal pixel, S is the area of the single pixel, $S_{Pi}$ is an area of a portion of the $i^{-th}$ edge pixel located within the display region, a is the area of the dark region, $d_i$ is a distance from a center of the $i^{-th}$ edge pixel to a center of the dark region, d is a distance from a center of the diagonal pixel to the center of the dark region, and L is display luminance of the single pixel other than the neighboring pixels in the display region, under a predetermined color.

In an embodiment of the present disclosure, the luminance of the edge pixel may be determined by the following equation:

$$L(P_i) = \frac{S_{Pi}}{S} * L,$$

the luminance of the diagonal pixel may be determined by the following equation:

$$L(P_3) = L + \frac{a}{S} * L,$$

where, i is an integer greater than or equal to one, $L(P_i)$ is the luminance of a $i^{-th}$ edge pixel, $L(P_3)$ is the luminance of the diagonal pixel, S is the area of the single pixel, Sp, is an area of a portion of the $i^{-th}$ edge pixel located within the display region, a is the area of the dark region, and L is display luminance of the single pixel other than the neighboring pixels in the display region, under a predetermined color.

In an embodiment of the present disclosure, a pixel in the pixel region that intersects the boundary is a boundary pixel which may have a first portion within the display region and a second portion outside the display region, in the case where a ratio of an area of the first portion to the area of the single pixel is less than a predetermined threshold, the boundary pixel is set as a non-display pixel, and the dark region may further include the first portion of the boundary pixel within the display region.

In an embodiment of the present disclosure, in the case where the neighboring pixel shares common edges with different dark regions at the same time, the luminance of the neighboring pixel adjacent to the dark region among the display pixels of the pixel region may be determined based on the area of the dark region having the smallest area among the different dark regions.

In an embodiment of the present disclosure, in the case where the neighboring pixel shares common edges with different dark regions at the same time, the luminance of the neighboring pixel adjacent to the dark regions among the display pixels of the pixel region may be determined based on an average area of the different dark regions.

In an embodiment of the present disclosure, the predetermined threshold is 50%.

In an embodiment of the present disclosure, the display panel may further include a thin film transistor for driving a pixel, wherein a width-to-length ratio of the thin film transistor for driving the neighboring pixel may be determined by the following steps: determining a current of the thin film transistor for driving the corresponding neighboring pixel based on the determined luminance of the neighboring pixel adjacent to the dark region, and determining the width-to-length ratio of the thin film transistor based on the current.

In an embodiment of the present disclosure, the display region may have a circular or elliptical shape.

Another aspect of the present disclosure provides a display panel. The display panel may include a display region and a non-display region, the display region and the non-display region having a boundary therebetween, the boundary passing through a pixel region and a non-pixel region of the display panel, a portion of the non-pixel region located within the display region forming a dark region within the display region, a width-to-length ratio of a thin film transistor for driving the neighboring pixel adjacent to the dark region being set to be different from the width-to-length ratio of the thin film transistor in the display region for driving a pixel other than the neighboring pixels, so as to compensate for the luminance of the dark region by means of the luminance of the neighboring pixel.

In an embodiment of the present disclosure, the neighboring pixels may include at least two edge pixels each sharing a common edge with the dark region.

In an embodiment of the present disclosure, the neighboring pixels may include at least two edge pixels each sharing a common edge with the dark region and a diagonal pixel disposed diagonally to the dark region.

In an embodiment of the present disclosure, a pixel in the pixel region that intersects the boundary is a boundary pixel, the boundary pixel may have a first portion within the display region and a second portion outside the display region, in the case where a ratio of an area of the first portion to the area of the single pixel is less than a predetermined threshold, the boundary pixel is set as a non-display pixel, and the dark region may further include the first portion of the non-display pixel within the display region.

Another aspect of the present disclosure provides a display device. The display device may include the above display panel.

Further aspects and areas of applicability will become apparent from the description provided herein. It should be understood that various aspects of this application may be implemented individually or in combination with one or more other aspects. It should also be understood that the description and specific examples herein are intended for purposes of illustration only and are not intended to limit the scope of the present application.

BRIEF DESCRIPTION OF THE DRAWINGS

The drawings described herein are used for purposes of illustration of selected embodiments, rather than all the possible embodiments, and are not intended to limit the scope of the application, in which.

Corresponding reference numerals indicate corresponding parts or features throughout the several views of the drawings.

DETAILED DESCRIPTION

Example embodiments will now be described more fully with reference to the accompanying drawings.

Notably, the figures and the examples below are not meant to limit the scope of the present disclosure. Where certain elements of the present disclosure may be partially or fully implemented using known components (or methods or processes), only those portions of such known components (or methods or processes) that are necessary for an understanding of the present disclosure will be described, and the detailed descriptions of other portions of such known components (or methods or processes) will be omitted so as not to obscure the disclosure. Further, various embodiments encompass present and future known equivalents to the components referred to herein by way of illustration.

In addition, the flow diagrams depicted herein are just one example. There may be many variations to this diagram or the steps (or operations) described therein without departing from the spirit of the disclosure. For instance, the steps may be performed in a differing order or steps may be added, deleted, or modified. All of these variations are considered a part of the claimed aspect.

As used herein and in the appended claims, the singular form of a word includes the plural, and vice versa, unless the context clearly dictates otherwise. Therefore, when a singular form of a term is mentioned, the plural form of the corresponding term is usually included. Similarly, the words "comprise", "include" and grammatical variations are to be interpreted inclusively rather than exclusively.

In non-rectangular (such as circular, elliptical) display panels, each pixel has a rectangular design. In the case where such rectangular pixels are arranged in a non-rectangular display panel, the pixels located at the edge of the display panel will not completely match the edges of the display panel. That is, there are blank regions at the edges of the display panel where pixels cannot be arranged, so a step structure having dark regions is formed near the edge of the display panel. As a result, although such a display panel is circular in appearance, since the blank regions in the step structure cannot emit light, the user may percept the difference in luminance caused by the step structure when displaying, thereby affecting the display effect.

In the embodiments described herein, various embodiments of the present disclosure are explained and illustrated with a circular display panel as an example. However, it may be understood that the embodiments of the present disclosure are also applicable to non-rectangular display panels with other shapes, such as oval, triangle, or semi-circle.

Figure 1:
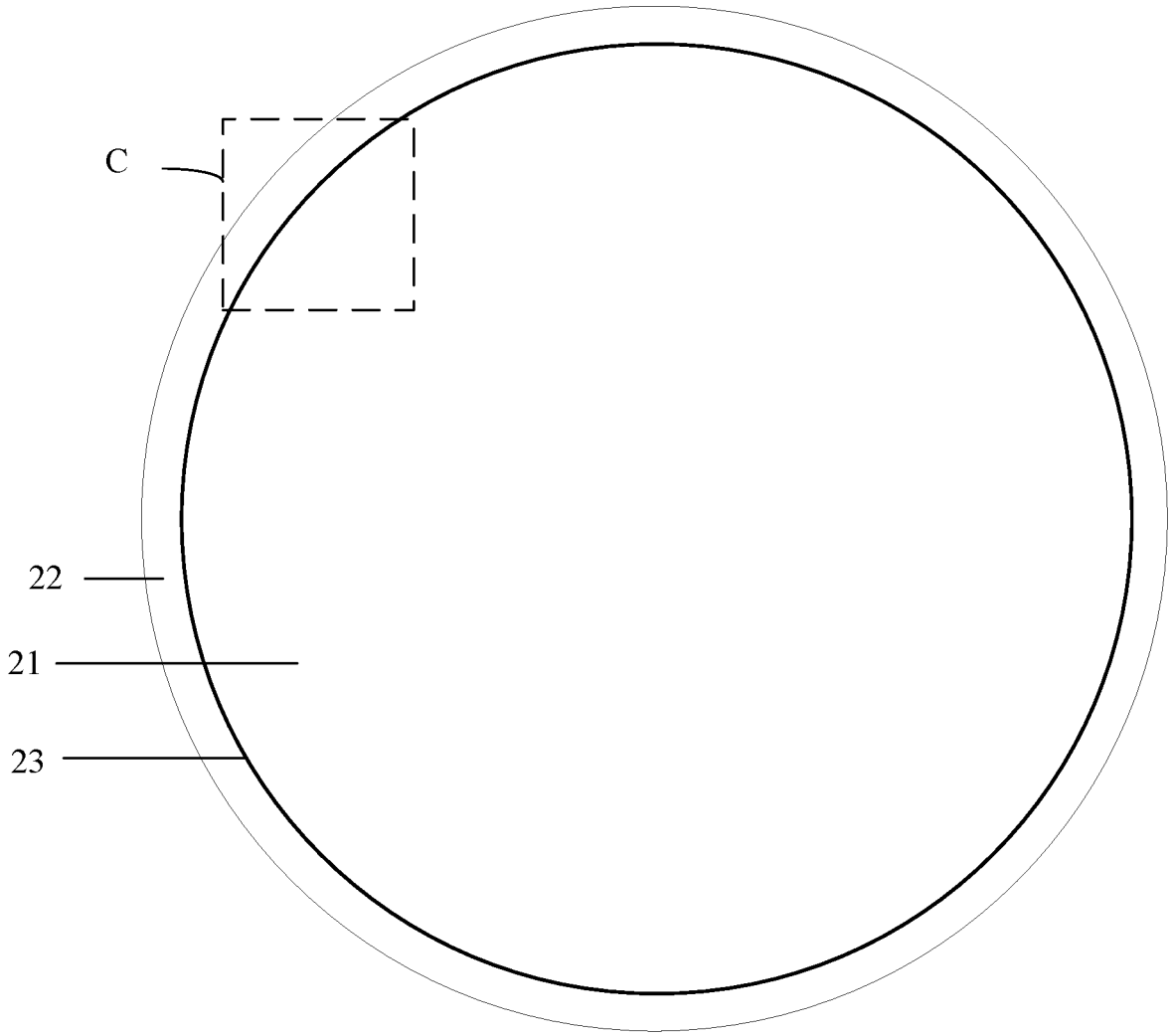
FIG. 1 illustrates a schematic diagram of an exemplary display panel according to an embodiment of the present disclosure.
Figures 2, 3:
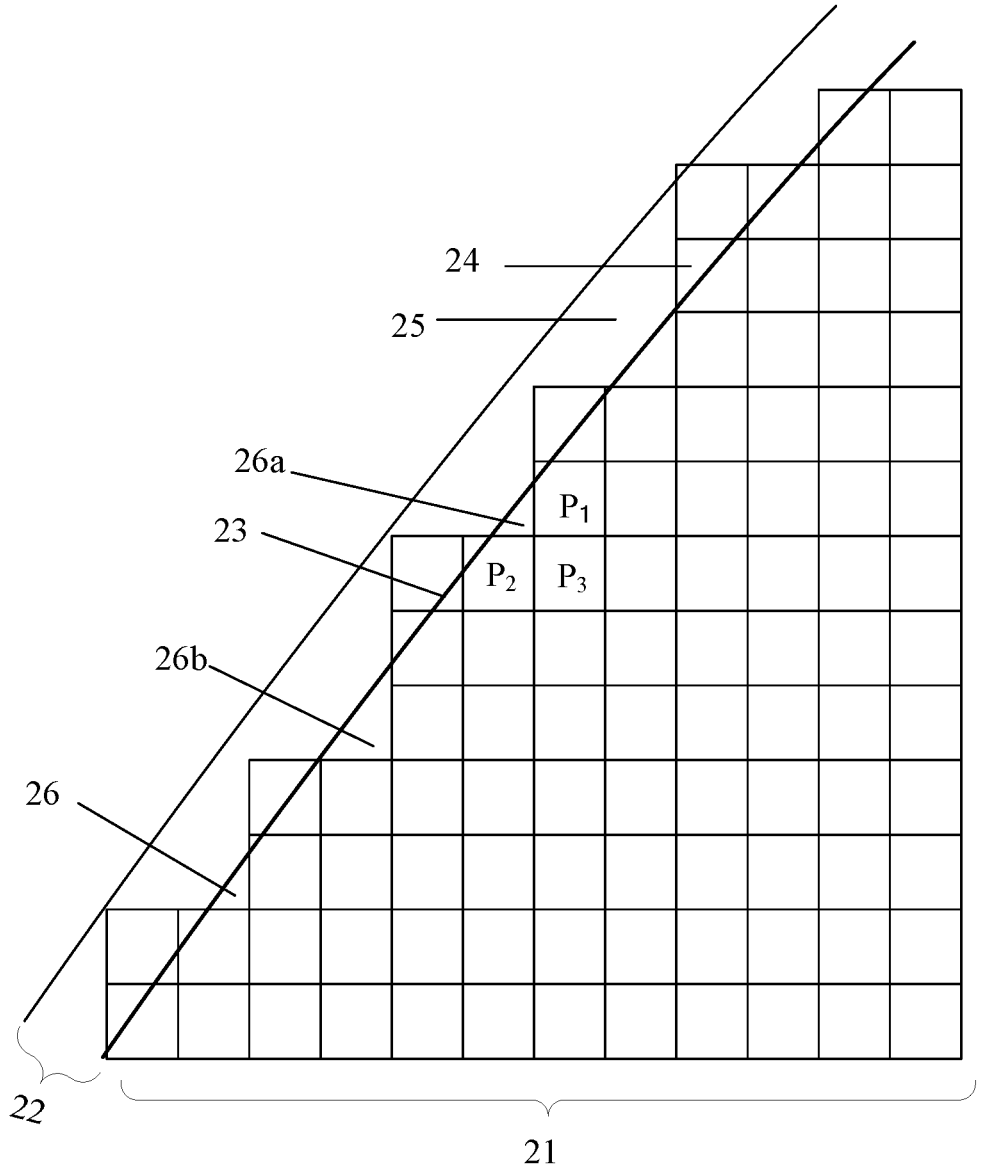
FIG. 2 illustrates an enlarged view of a region C within a dotted line in FIG. 1.
FIG. 3 illustrates an exemplary flow chart of a method of determining the width-to-length ratio of a TFT for driving neighboring pixel in an embodiment of the present disclosure.

FIG. 1 illustrates a schematic diagram of an exemplary display panel in an embodiment of the present disclosure. FIG. 2 illustrates an enlarged view of a region C within a dotted line in FIG. 1. As shown in FIGS. 1 and 2, the display panel includes a display region 21 and a non-display region 22. The display region 21 and the non-display region 22 have a boundary 23 therebetween, and the boundary 23 passes through a pixel region 24 (i.e., a region provided with pixels) and a non-pixel region 25 (i.e., a region provided with no pixel) of the display panel. A portion of the non-pixel region 25 located within the display region 21 forms a dark region 26 within the display region 21.

As an example, for a smart watch, the display region 21 may be a region where the dial of the smart watch is located, and the non-display region 22 may be a region where the watchcase of the smart watch is located. In the embodiment of the present disclosure, the display region 21 and the non-display region 22 are separated by the boundary 23.

FIG. 3 illustrates an exemplary flow chart of a method for compensating for luminance of a display panel according to an embodiment of the present disclosure. As shown in FIG. 3, the method for compensating for the luminance of the display panel includes step 301. In step 301, the luminance of a neighboring pixel adjacent to the dark region among the display pixels of the pixel region 24 is determined based on an area of the dark region, so as to compensate for the luminance of the dark region with the luminance of the neighboring pixel.

In the embodiment of the present disclosure, "display pixels of the pixel region" refer to pixels that emit light when the display panel displays an image.

According to the method provided by the embodiment of the present disclosure, the luminance of the dark region is compensated by the luminance of the neighboring pixel adjacent to the dark region determined based on the area of the dark region, so the difference between the luminance of the dark region and the luminance of the neighboring pixel may be reduced, and thus it is not obvious to users' eyes.

In the embodiment of the present disclosure, the neighboring pixels may include edge pixels each having a common edge with the dark region and a diagonal pixel disposed diagonally to the dark region. As shown in FIG. 2, the dark region 26*a* has two edge pixels $P_1$, $P_2$ and one diagonal pixel $P_3$. Depending on the arrangement of pixels in the display panel, the dark region 26 may also have more than two edge pixels, for example, the dark region 26*b* shown in FIG. 2 has three edge pixels. For simplifying the description and in order not to obscure the disclosure, only the embodiment in which the dark region 26 has two edge pixels $P_1$, $P_2$ will be described in detail herein. It should be understood that embodiments that have more than two edge pixels are also suitable for the present disclosure.

In an exemplary embodiment of the present disclosure, the luminance of each neighboring pixel determined in step 301 may be divided into two parts: a base part for the normal display of the neighboring pixel, and a compensation part for compensating for the luminance of the dark region. The base part is proportional to a ratio of an area of a portion of the corresponding neighboring pixel of each dark region located within the display region to an area of a single pixel, and for each dark region, a sum of the compensation parts of all neighboring pixels is proportional to a ratio of the area of the dark region to the area of the single pixel.

It should be noted that in embodiments of the present disclosure, the luminance of each neighboring pixel is divided into a base part and a compensation part merely for convenience of description. In practice, the luminance of each neighboring pixel acts as a whole, on the one hand, for the need for the neighboring pixel itself to emit light, and on the other hand, for increasing the luminance of the neighboring dark region.

Several examples for determining the luminance of the edge pixels and diagonal pixel of the dark region are described in detail below with reference to FIG. 2 with the dark region 26*a* as an example. For other dark regions, a similar approach may be adopted to determine the luminance of neighboring pixels in the dark region.

Example 1

In this example, the compensation for the luminance of the dark region 26*a* is achieved by adjusting the luminance of the edge pixels $P_1$, $P_2$ of the dark region 26*a*, while the diagonal pixel $P_3$ of the dark region 26*a* may have the luminance same as or similar to that of other pixels than the edge pixels.

Specifically, the luminance of the edge pixel $P_j$, and the luminance of the edge pixel $P_2$ may be determined by the following equations, respectively:

$$L(P_1) = \frac{S_{P1}}{S} * L + \frac{a}{S} * \frac{d_1}{d_1 + d_2} * L; \tag{1}$$

-continued $$L(P_2) = \frac{S_{P2}}{S} * L + \frac{a}{S} * \frac{d_2}{d_1 + d_2} * L, \quad (2)$$

where, $L(P_1)$ and $L(P_2)$ are the determined luminance of the edge pixel $P_1$ and the determined luminance of the edge pixel $P_2$, respectively, S is the area of the single pixel, $S_{P1}$ and $S_{P2}$ are respectively an area of the portion of the edge pixel $P_1$ located within the display region and an area of the portion of the edge pixel $P_2$ located within the display region, a is the area of the dark region 26*a*, $d_1$ and $d_2$ are distances from the centers of the edge pixel $P_1$ and $P_2$ to the center of the corresponding dark region 26*a*, respectively, and L is display luminance of the single pixel other than the edge pixels in the display region, under a predetermined color (for example, full white display).

In this example, the base part of the luminance of the edge pixel $P_1$ is equal to the ratio of the area of the portion of the corresponding edge pixel located within the display region to the area of the single pixel, multiplied by the display luminance of the single pixel under a predetermined color, i.e., $$\frac{S_{P1}}{S} * L,$$

and the base part of the luminance of the edge pixel $P_2$ is equal to the ratio of the area of the portion of the corresponding edge pixel located within the display region to the area of the single pixel, multiplied by the display luminance of the single pixel under the predetermined color, i.e., $$\frac{S_{P2}}{S} * L,$$

the compensation part of the luminance of the edge pixel $P_1$ is equal to the ratio of the area of the dark region 26*a* to the area of the single pixel, multiplied by the ratio of the distance from the single edge pixel to the center of the dark region 26*a* to the sum of the distances from the side pixels $P_1$ and $P_2$ to the center of the dark region 26*a*, then multiplied by the display luminance of the single pixel under the predetermined color, i.e., $$\frac{a}{S} * \frac{d_1}{d_1 + d_2} * L,$$

and the compensation part of the luminance of the edge pixel $P_2$ is equal to the ratio of the area of the dark region 26*a* to the area of the single pixel multiplied by the ratio of the distance from the single edge pixel to the center of the dark region 26*a* to the sum of the distances from the edge pixels $P_1$ and $P_2$ to the center of the dark region 26*a*, then multiplied by the display luminance of the single pixel under the predetermined color, i.e., $$\frac{a}{S} * \frac{d_2}{d_1 + d_2} * L.$$

It can be seen from the equations (1) and (2) that the sum of the compensation parts of the luminance of the edge pixels $P_1$, $P_2$ is proportional to the ratio of the area of the dark region to the area of the single pixel, that is, equal to a/S*L.

In the case where there are more than two edge pixels, the above equations (1) and (2) may be further rewritten as:

$$L(P_i) = \frac{S_{Pi}}{S} * L + \frac{a}{S} * \frac{d_i}{\sum_{j=1}^{n} d_j} * L;$$

where, i=1, . . . , n, n is a positive integer greater than or equal to two.

Example 2

In this example, similar to Example 1, the compensation for the luminance of the dark region 26*a* is achieved by adjusting the luminance of the edge pixels $P_1$, $P_2$ of the dark region 26*a*, while the diagonal pixel $P_3$ of the dark region 26*a* may have luminance same as or similar to that of other pixels.

Specifically, the luminance of the edge pixel $P_1$ and the luminance of the edge pixel $P_1$ may be determined by the following equation, respectively:

$$L(P_1) = \frac{S_{P1}}{S} * L + \frac{a}{S} * \frac{b_1}{b_1 + b_2} * L; \quad (3)$$

$$L(P_2) = \frac{S_{P2}}{S} * L + \frac{a}{S} * \frac{b_2}{b_1 + b_2} * L, \quad (4)$$

where, $L(P_1)$ and $L(P_2)$ are the determined luminance of the edge pixel $P_1$ and the determined luminance of the edge pixel $P_2$, respectively, S is the area of the single pixel, $S_{P1}$ and $S_{P2}$ are an area of a portion of the edge pixel $P_1$ located within the display region and an area of a portion of the edge pixel $P_2$ located within the display region, respectively, a is the area of the dark region 26*a*, $b_1$ and $b_2$ are a length of a common portion of an edge of the edge pixel $P_1$ and an edge of the corresponding dark region 26*a* and a length of a common portion of an edge of the edge pixel $P_2$ and an edge of the corresponding dark region 26*a*, respectively, and L is display luminance of the single pixel other than the edge pixels in the display region, under a predetermined color (e.g. full white display).

In this example, the base part of the luminance of the edge pixel $P_1$ is equal to the ratio of the area of the portion of the corresponding edge pixel located within the display region to the area of the single pixel, multiplied by the display luminance of the single pixel under a predetermined color, i.e., $$\frac{S_{P1}}{S} * L,$$

and the base part of the luminance of the edge pixel $P_2$ is equal to the ratio of the area of the portion of the corresponding edge pixel located within the display region to the area of the single pixel, multiplied by the display luminance of the single pixel under the predetermined color, i.e., $$\frac{S_{P2}}{S} * L,$$

the compensation part of the luminance of the edge pixel $P_1$ is equal to the ratio of the area of the dark region 26*a* to the area of the single pixel, multiplied by the ratio of the length of the common portion of the edge of the respective edge pixel and the edge of the dark region 26*a* to the sum of the lengths of the common portions of the edges of the edge pixel $P_1$ and the edge of the dark region 26*a*, then multiplied by the display luminance of the single pixel under the predetermined color, i.e., $$\frac{a}{S} * \frac{b_1}{b_1 + b_2} * L,$$

and the compensation part of the luminance of the edge pixel $P_2$ is equal to the ratio of the area of the dark region 26*a* to the area of the single pixel, multiplied by the ratio of the length of the common portion of the edge of the respective edge pixel and the edge of the dark region 26*a* to the sum of the lengths of the common portions of the edges of the edge pixel $P_2$ and the edge of the dark region 26*a*, then multiplied by the display luminance of the single pixel under the predetermined color, i.e., $$\frac{a}{S} * \frac{b_2}{b_1 + b_2} * L.$$

It can be seen from the equations (3) and (4) that the sum of the compensation parts of the luminance of the edge pixels $P_1$, $P_2$ is proportional to the ratio of the area of the dark region 26*a* to the area of the single pixel, that is, equal to a/S*L.

In the case where there are more than two edge pixels, the above equations (3) and (4) may be further rewritten as:

$$L(P_i) = \frac{S_{Pi}}{S} * L + \frac{a}{S} * \frac{b_i}{\sum_{j=1}^{n} b_j} * L;$$

where, i=1, . . . , n, n is a positive integer greater than or equal to two.

Example 3

In this example, the compensation for the luminance of the dark region 26*a* is achieved by adjusting the luminance of the edge pixels $P_1$, $P_2$ and the diagonal pixel $P_3$ of the dark region 26*a*.

Specifically, the luminance of the edge pixel $P_1$ and the luminance of the edge pixel $P_2$ may be determined by the following equations, respectively:

$$L(P_1) = \frac{S_{P1}}{S} * L + \frac{a}{S} * \frac{d_1}{d_1 + d_2 + d} * L; \quad (5)$$

$$L(P_2) = \frac{S_{P2}}{S} * L + \frac{a}{S} * \frac{d_2}{d_1 + d_2 + d} * L, \quad (6)$$

Specifically, the luminance of the diagonal pixel P3 of the dark region may be determined by the following equation:

$$L(P_3) = L + \frac{a}{S} * \left(1 - \frac{d_1}{d_1 + d_2 + d} - \frac{d_2}{d_1 + d_2 + d}\right) * L \quad (7)$$

where, $L(P_1)$ and $L(P_2)$ are the determined luminance of the edge pixel $P_1$ and the determined luminance of the edge pixel $P_2$, respectively, $L(P_3)$ is the determined luminance of the diagonal pixel $P_3$, S is the area of the single pixel, $S_{P1}$ and $S_{P2}$ are respectively an area of a portion of the edge pixel $P_1$ located within the display region 21 and an area of a portion of the edge pixel $P_2$ located within the display region 21, a is the area of the dark region 26*a*, $d_1$ and $d_2$ are a distance from a center of the edge pixel $P_1$ to a center of the corresponding dark region 26*a* and a distance from a center of the edge pixel $P_2$ to a center of the corresponding dark region 26*a*, respectively, d is a distance from a center of the diagonal pixel $P_3$ to the center of the corresponding dark region 26*a*, and L is the display luminance of the single pixel other than the edge pixels in the display region, under a predetermined color (for example, full white display).

In this example, the base part of the luminance of the edge pixel $P_1$ is equal to the ratio of the area of the portion of the corresponding edge pixel located within the display region 21 to the area of the single pixel multiplied by the display luminance of the single pixel under the predetermined color, i.e., $$\frac{S_{P1}}{S} * L$$

and the base part of the luminance of the edge pixel $P_2$ is equal to the ratio of the area of the portion of the corresponding edge pixel located within the display region 21 to the area of the single pixel multiplied by the display luminance of the single pixel under the predetermined color, i.e., $$\frac{S_{P2}}{S} * L,$$

the compensation part of the luminance of the edge pixel $P_1$ is equal to the ratio of the area of the dark region 26*a* to the area of the single pixel, multiplied by the ratio of the distance from the respective edge pixel $P_1$ to the center of the dark region 26*a* to the sum of the distances from the edge pixels $P_1$, $P_2$ and the diagonal pixel $P_3$ to the center of the dark region 26*a*, then multiplied by the display luminance of the single pixel under the predetermined color, i.e., $$\frac{a}{S} * \frac{d_1}{d_1 + d_2 + d} * L$$

and the compensation part of the luminance of the edge pixel $P_2$ is equal to the ratio of the area of the dark region 26*a* to the area of the single pixel, multiplied by the ratio of the distance from the respective edge pixel $P_2$ to the center of the dark region 26*a* to the sum of the distances from the edge pixels $P_1$, $P_2$ and the diagonal pixel $P_3$ to the center of the dark region 26*a*, then multiplied by the display luminance of the single pixel under the predetermined color, i.e., $$\frac{a}{S} * \frac{d_2}{d_1 + d_2 + d} * L.$$

The base part of the luminance of the diagonal pixel $P_3$ is equal to the luminance L of the single pixel other than the diagonal pixels and edge pixels, the compensation part of the luminance of the diagonal pixel $P_3$ is equal to the ratio of the area of the dark region 26*a* to the area of the single pixel, multiplied by L, minus the compensation parts of the luminance of the edge pixels $P_1$, $P_2$, that is, $$\frac{a}{S} * L - \frac{a}{S} * \frac{d_1}{d_1 + d_2 + d} * L - \frac{a}{S} * \frac{d_2}{d_1 + d_2 + d} * L.$$

It can be seen from the equations (5) to (7) that the sum of the compensation parts of the luminance of the edge pixels $P_1$, $P_2$ and the compensation part of the diagonal pixel $P_3$ is proportional to the ratio of the area of the dark region to the area of the single pixel, that is, equal to a/S*L.

In the case where there are more than two edge pixels, the above equations (5) and (6) may be further rewritten as:

$$L(P_i) = \frac{S_{Pi}}{S} * L + \frac{a}{S} * \frac{d_i}{\sum_{j=1}^{n} d_j + d} * L;$$

the above equation (7) may be further rewritten as:

$$L(P_3) = L + \frac{a}{S} * L - \frac{a}{S} * \sum_{k=1}^{n} \frac{d_k}{\sum_{j=1}^{n} d_j + d} * L$$

where, i=1, . . . , n, n is a positive integer greater than or equal to two.

Example 4

In this example, the compensation for the luminance of the dark region 26*a* is achieved by adjusting the luminance of the diagonal pixel $P_3$ of the dark region 26*a*.

Specifically, the luminance of the edge pixel $P_1$ and the luminance of the edge pixel $P_2$ may be determined by the following equations, respectively:

$$L(P_1) = \frac{S_{P1}}{S} * L; \quad (8)$$

$$L(P_2) = \frac{S_{P2}}{S} * L, \quad (9)$$

The luminance of the diagonal pixel P3 may be determined by the following equation:

$$L(P_3) = L + \frac{a}{S} * L, \quad (10)$$

where, $L(P_1)$ and $L(P_2)$ are the determined luminance of the edge pixel $P_1$ and the determined luminance of the edge pixel $P_2$, respectively, $L(P_3)$ is the determined luminance of the diagonal pixel $P_3$, S is the area of the single pixel, $S_{P1}$ and $S_{P2}$ are respectively an area of a portion of the edge pixel $P_1$ located within the display region 21 and an area of a portion of the edge pixel $P_2$ located within the display region 21, a is the area of the dark region 26*a*, and L is display luminance of the single pixel other than the neighboring pixels in the display region, under the predetermined color (for example, full white display).

In this example, the luminance of the edge pixel $P_1$ and the luminance of the edge pixel $P_2$ of the dark region 26*a* have only the base part $$\frac{S_{P1}}{S} * L$$

and the base part $$\frac{S_{P2}}{S} * L,$$

respectively, without the compensation part. That is, the compensation part thereof is zero. The base part of the luminance of the diagonal pixel $P_3$ of the dark region 26*a* is equal to the luminance L of the single pixel other than the diagonal pixel and edge pixels, and the compensation part of the luminance of the diagonal pixel $P_3$ is equal to the ratio of the area of the dark region to the area of the single pixel multiplied by L, i.e., a/S*L.

In the case where there are more than two edge pixels, the above equations (8) and (9) may be further rewritten as:

$$L(P_i) = \frac{S_{Pi}}{S} * L;$$

where, i=1, . . . , n, n is a positive integer greater than or equal to two.

Figure 4:
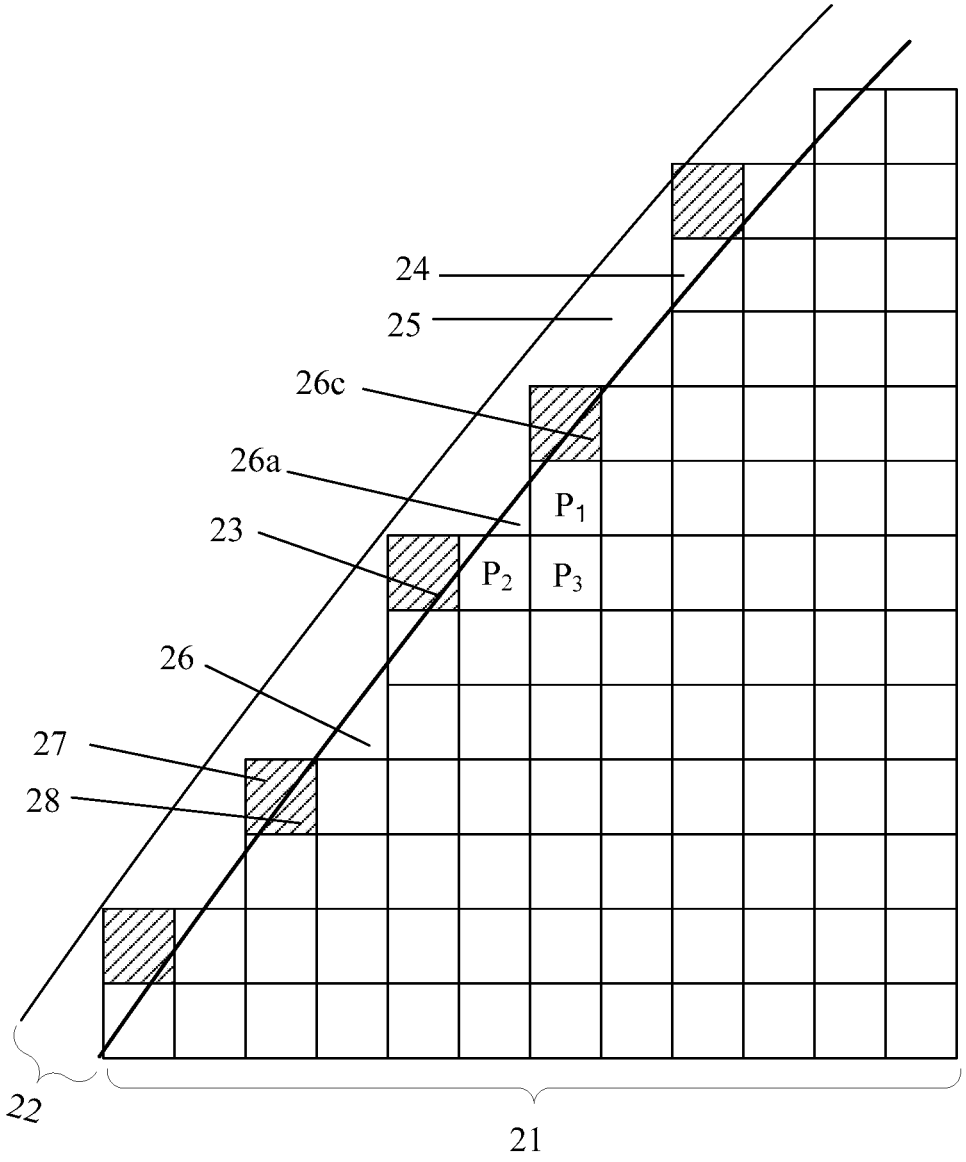
FIG. 4 illustrates a partial schematic view of another exemplary display panel according to an embodiment of the present disclosure.

FIG. 4 illustrates a partial schematic view of another exemplary display panel according to an embodiment of the present disclosure. The display panel shown in FIG. 4 and the display panel shown in FIG. 2 may have the same pixel arrangement. However, in FIG. 4, a pixel in the pixel region 24 that intersects the boundary 23 is set as a boundary pixel which has a first portion inside the display region 21 and a second portion outside the display region 21, when the ratio of the area of the first portion to the area of the single pixel is less than a predetermined threshold (for example, a predetermined percentage), the boundary pixel is set as a non-display pixel 27, and the dark region 26 further includes the first portion 28 of the non-display pixel 27 located within the display region 21.

In this embodiment, "a non-display pixel" refers to a pixel that does not emit light when the display panel displays an image.

In this embodiment, the luminance difference between the dark region and the peripheral pixels may be further reduced by making the boundary pixel satisfying the above-described predetermined condition not to emit light, thereby addressing the obvious non-uniform luminance of the edges of the display region.

In an embodiment of the present disclosure, the predetermined threshold may be about 50%.

For the dark region caused by the portion of the non-display pixel located within the display region, the same method as that in the previously described embodiment may be used for the compensation, which will not be described herein.

In the case where a neighboring pixel, especially edge pixel, shares common edges with different dark regions at the same time, in an embodiment, the luminance of the neighboring pixel may be determined based on the area of the one of the two dark regions with a smaller area. In another embodiment, the luminance of the neighboring pixel may be determined based on an average area of the two dark regions.

As shown in FIG. 4, the dark region 26*a* and the dark region 26*c* share the same edge pixel $P_1$. In this case, the luminance of the edge pixel $P_1$ may be calculated by selecting the value of a in the equations (1)-(6) to be the area of the dark region with a smaller area in the dark region 26*a* and the dark region 26*c* (for example, the dark region 26*a* in FIG. 4). Alternatively, the luminance of the edge pixel $P_1$ may be calculated by selecting a in the equations (1)-(6) as the average area of the dark region 26*a* and the dark region 26*c*. Other embodiments are also possible.

In an embodiment of the present disclosure, the display panel further includes a thin film transistor for driving a pixel. In an exemplary embodiment, the luminance of neighboring pixels of the display panel may be controlled by changing the width-to-length ratio of the thin film transistor 51.

Figure 5:
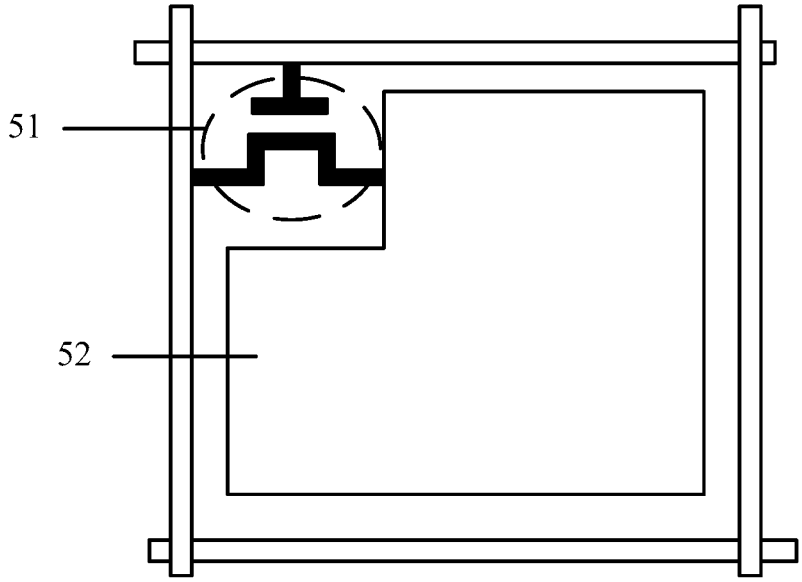
FIG. 5 exemplarily illustrates one pixel and a thin film transistor for driving the pixel to emit light.

FIG. 5 exemplarily illustrates a pixel and a thin film transistor for driving the pixel to emit light. As shown in FIG. 5, the pixel may include a thin film transistor 51 and a pixel electrode 52 connected to the thin film transistor 51. However, it should be understood that the specific type and structure of the thin film transistor are not limited in embodiments of the present disclosure and may be appropriately selected according to actual needs. Additionally, as known to those skilled in the art, "the width-to-length ratio of a thin film transistor" is a ratio of the width to length of an electrically conductive channel.

Figure 6:
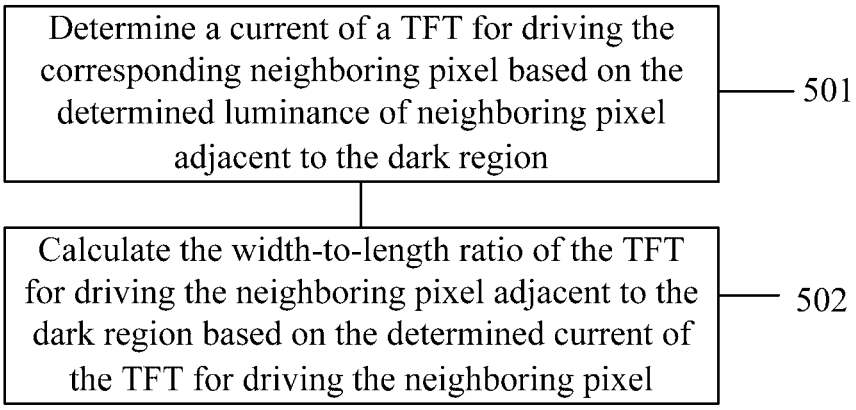
FIG. 6 illustrates an exemplary flow chart of a method for compensating for luminance of a display panel according to an embodiment of the present disclosure.

FIG. 6 illustrates an exemplary flow chart of a method of determining the width-to-length ratio of a TFT for driving a neighboring pixel in an embodiment of the present disclosure. As shown in FIG. 6, the method of determining the width-to-length ratio of a TFT for driving a neighboring pixel includes the following steps 501 and 502.

In step 501, a current of the TFT for driving the corresponding neighboring pixel is determined based on the determined luminance of the neighboring pixel adjacent to the dark region.

In this step, the luminance of the neighboring pixel may be pre-determined using any of the examples described above regarding determining the luminance of the neighboring pixels. In a specific embodiment, the driving current of the TFT for driving the neighboring pixel may be determined according to a proportional relationship between the luminance of the pixel and the driving current of the TFT. The proportional relationship is $L_p$=KI, where $L_p$ is the luminance of the neighboring pixel adjacent to the corresponding dark region, K is a proportional coefficient, which may be determined manually or determined experimentally, and I is the driving current.

In step 502, the width-to-length ratio of the TFT for driving the neighboring pixel adjacent to the dark region is calculated based on the determined current of the TFT for driving the neighboring pixel.

In this step, the width-to-length ratio of the TFT for driving the neighboring pixel may be calculated based on the current equation $$I = \frac{1}{2} * (Cox * W / L) * (V_{gs} - V_{th}),$$

where Cox is the capacitance of a gate oxide layer per unit area, W/L is the width-to-length ratio of the TFT, $V_{gs}$ is the gate source voltage of the TFT, and $V_{th}$ is the threshold voltage of the TFT.

Another aspect of the present disclosure provides a display panel. As shown in FIGS. 2 and 4, the display panel includes a display region 21 and a non-display region 22, and a boundary 23 exists between the display region 21 and the non-display region 22. The boundary 23 passes through the pixel region 24 and the non-pixel region 25 of the display panel. A portion of the non-pixel region 25 located inside the display region 21 forms a dark region 26 within the display region, and a width-to-length ratio of a thin film transistor 51 for driving the neighboring pixel adjacent to the dark region 26 (e.g., the thin film transistor shown in FIG. 5) is set to be different from the width-to-length ratio of the thin film transistor 51 of other pixels in the display region 21 than the neighboring pixel so as to compensate for the luminance of the dark region 26 by means of the luminance of the neighboring pixels.

In this configuration, the luminance of the neighboring pixels adjacent to the corresponding dark region is different from the luminance of other pixels in the display region by changing the width-to-length ratio of the thin film transistor, which may reduce the difference between the luminance of the dark region and the luminance of the neighboring pixels, so that this difference is not obvious to users' eyes. Therefore, it is possible to address the obvious non-uniform luminance of the edges of the display region.

In an embodiment of the present disclosure, the neighboring pixels may include at least two edge pixels each sharing a common edge with the dark region.

In an embodiment of the present disclosure, the neighboring pixels may further include diagonal pixel diagonally disposed to the dark region.

In an embodiment of the present disclosure, a pixel in the pixel region that intersects the boundary is a boundary pixel, which may have a first portion located within the display region and a second portion located outside the display region. In the case where a ratio of an area of the first portion to an area of the single pixel is less than a predetermined threshold, the boundary pixel is set as a non-display pixel, and the dark region further includes the first portion of the non-display pixel located within the display region.

Further provided in an embodiment of the present disclosure is a display device. The display device may include the display panel described in any of the embodiments related to the display panel herein. Therefore, for alternative embodiments of the display device, reference may be made to the embodiments of the display panel described herein.

The foregoing description of the embodiment has been provided for purpose of illustration and description. It is not intended to be exhaustive or to limit the application. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the application, and all such modifications are included within the scope of the application.

What is claimed is:

1. A method for compensating for luminance of a display panel, wherein the display panel comprises:

a display region and a non-display region, the display region and the non-display region having a boundary therebetween, the boundary passing through a pixel region and a non-pixel region of the display panel, a portion of the non-pixel region located within the display region forming a dark region within the display region, the method comprising:

determining the luminance of a neighboring pixel adjacent to the dark region among display pixels of the pixel region based on an area of the dark region, so as to compensate for the luminance of the dark region with the luminance of the neighboring pixel.

2. The method according to claim 1, wherein the determined luminance of the neighboring pixel comprises a base part and a compensation part for compensating for the luminance of the dark region, wherein the base part is proportional to a ratio of an area of a portion of the corresponding neighboring pixel located within the display region to an area of a single pixel, and wherein for each dark region, a sum of the compensation parts of all neighboring pixels is proportional to a ratio of the area of the dark region to the area of the single pixel.

3. The method according to claim 2, wherein the neighboring pixels comprise at least two edge pixels each sharing a common edge with the dark region.

4. The method according to claim 3, wherein the luminance of the edge pixel is determined by the following equation:

$$L(P_i) = \frac{S_{Pi}}{S} * L + \frac{a}{S} * \frac{d_i}{\sum_{j=1}^{n} d_j} * L;$$

where, i=1, . . . , n, n is a positive integer greater than or equal to two;

$L(P_i)$ is the luminance of a i-th edge pixel;

S is the area of the single pixel;

$S_{Pi}$ is an area of a portion of the $i^{-th}$ edge pixel located within the display region;

a is the area of the dark region;

$d_i$ is a distance from a center of the $i^{-th}$ edge pixel to a center of the dark region; and L is display luminance of the single pixel other than the neighboring pixels in the display region, under a predetermined color.

5. The method according to claim 3, wherein the luminance of the edge pixel is determined by the following equation:

$$L(P_i) = \frac{S_{Pi}}{S} * L + \frac{a}{S} * \frac{b_i}{\sum_{j=1}^{n} b_j} * L;$$

where, i=1, . . . , n, n is a positive integer greater than or equal to two;

$L(P_i)$ is the luminance of a i-th edge pixel;

S is the area of the single pixel;

$S_{Pi}$ is an area of a portion of the i-th edge pixel located within the display region;

a is the area of the dark region;

$b_i$ is a length of a common portion of an edge of the $i^{-th}$ edge pixel and a edge of the dark region; and L is display luminance of the single pixel other than the neighboring pixels in the display region, under a predetermined color.

6. The method according to claim 2, wherein the neighboring pixels comprise at least two edge pixels each sharing a common edge with the dark region and a diagonal pixel disposed diagonally to the dark region.

7. The method according to claim 6, wherein the luminance of the edge pixel is determined by the following equation:

$$L(P_i) = \frac{S_{Pi}}{S} * L + \frac{a}{S} * \frac{d_i}{\sum_{j=1}^{n} d_j + d} * L; \text{ and}$$

wherein the luminance of the diagonal pixel is determined by the following equation:

$$L(P_3) = L + \frac{a}{S} * L - \frac{a}{S} * \sum_{k=1}^{n} \frac{d_k}{\sum_{j=1}^{n} d_j + d} * L;$$

where, n is a positive integer greater than or equal to two, i=1, . . . , n;

$L(P_i)$ is the luminance of a $i^{-th}$ edge pixel;

$L(P_3)$ is the luminance of the diagonal pixel;

S is the area of the single pixel;

$S_{Pi}$ is an area of a portion of the $i^{-th}$ edge pixel located within the display region;

a is the area of the dark region;

$d_i$ is a distance from a center of the $i^{-th}$ edge pixel to a center of the dark region;

d is a distance from a center of the diagonal pixel to the center of the dark region; and L is display luminance of the single pixel other than the neighboring pixels in the display region, under a predetermined color.

8. The method according to claim 6, wherein the luminance of the edge pixel is determined by the following equation:

$$L(P_i) = \frac{S_{Pi}}{S} * L; \text{ and}$$

wherein the luminance of the diagonal pixel is determined by the following equation:

$$L(P_3) = L + \frac{a}{S} * L;$$

where, i is an integer greater than or equal to one;

$L(P_i)$ is the luminance of a $i^{-th}$ edge pixel;

$L(P_3)$ is the luminance of the diagonal pixel;

S is the area of the single pixel;

$S_{Pi}$ is an area of a portion of the $i^{-th}$ edge pixel located within the display region;

a is the area of the dark region; and

L is display luminance of the single pixel other than the neighboring pixels in the display region, under a predetermined color.

9. The method according to claim 1, wherein a pixel in the pixel region that intersects the boundary is a boundary pixel which has a first portion within the display region and a second portion outside the display region, and wherein in the case where a ratio of an area of the first portion to the area of the single pixel is less than a predetermined threshold, the boundary pixel is set as a non-display pixel, and the dark region further comprises the first portion of the boundary pixel within the display region.

10. The method according to claim 9, wherein, in the case where the neighboring pixel shares common edges with different dark regions at the same time, the luminance of the neighboring pixel adjacent to the dark region among the display pixels of the pixel region is determined based on the area of the dark region having the smallest area among the different dark regions.

11. The method according to claim 9, wherein, in the case where the neighboring pixel has common edges with different dark regions at the same time, the luminance of the neighboring pixel adjacent to the dark regions among the display pixels of the pixel region is determined based on an average area of the different dark regions.

12. The method according to claim 9, wherein the predetermined threshold is 50%.

13. The method according to claim 1, wherein the display panel further comprises a thin film transistor for driving a pixel, and wherein a width-to-length ratio of the thin film transistor for driving the neighboring pixel is determined by the following steps:

determining a current of the thin film transistor for driving the corresponding neighboring pixel based on the determined luminance of the neighboring pixel adjacent to the dark region; and determining the width-to-length ratio of the thin film transistor based on the current.

14. The method according to claim 1, wherein the display region has a circular or elliptical shape.

15. A display panel comprising a display region and a non-display region, the display region and the non-display region having a boundary therebetween, the boundary passing through a pixel region and a non-pixel region of the display panel, a portion of the non-pixel region located within the display region forming a dark region within the display region, a width-to-length ratio of a thin film transistor for driving the neighboring pixel adjacent to the dark region being set to be different from the width-to-length ratio of thin film transistor in the display region for driving a pixel other than the neighboring pixels, so as to compensate for the luminance of the dark region by means of the luminance of the neighboring pixel.

16. The display panel according to claim 15, wherein the neighboring pixels comprise at least two edge pixels each sharing a common edge with the dark region.

17. The display panel according to claim 15, wherein the neighboring pixels comprise at least two edge pixels each sharing a common edge with the dark region and a diagonal pixel disposed diagonally to the dark region.

18. The display panel according to claim 15, wherein a pixel in the pixel region that intersects the boundary is a boundary pixel which has a first portion within the display region and a second portion outside the display region, and wherein in the case where a ratio of an area of the first portion to the area of the single pixel is less than a predetermined threshold, the boundary pixel is set as a non-display pixel, and the dark region further comprises the first portion of the non-display pixel within the display region.

19. A display device comprising the display panel according to claim 15.

20. The display device according to claim 19, wherein the neighboring pixels comprise at least two edge pixels each sharing a common edge with the dark region and a diagonal pixel disposed diagonally to the dark region.

* * * * *